US007012573B2

(12) United States Patent
Tchistiakov et al.

(10) Patent No.: US 7,012,573 B2
(45) Date of Patent: Mar. 14, 2006

(54) WIDE BAND ANTENNA

(75) Inventors: Nikolai Tchistiakov, Nizhny Novgorod (RU); Seong-sin Joo, Suwon-si (KR); Dae-yeon Kim, Suwon-si (KR); Weon-kyo Jung, Anyang-si (KR); Hyun-koo Kang, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/060,532

(22) Filed: Feb. 18, 2005

(65) Prior Publication Data

US 2005/0184909 A1 Aug. 25, 2005

Related U.S. Application Data

(60) Provisional application No. 60/545,929, filed on Feb. 20, 2004.

(30) Foreign Application Priority Data

Feb. 23, 2004 (KR) ..... 10-2004-0011908

(51) Int. Cl.
*H01Q 9/28* (2006.01)

(52) U.S. Cl. ..... 343/795; 343/821

(58) Field of Classification Search ..... 343/700 MS, 343/795, 793, 702, 906, 820, 821, 822; H01Q 9/28
See application file for complete search history.

(56) References Cited

U.S. PATENT DOCUMENTS

| | | | | |
|---|---|---|---|---|
| 5,229,777 | A | 7/1993 | Doyle | |
| 6,018,324 | A * | 1/2000 | Kitchener | 343/795 |
| 6,747,605 | B1 * | 6/2004 | Lebaric et al. | 343/795 |
| 6,859,176 | B1 * | 2/2005 | Choi | 343/700 MS |
| 6,906,678 | B1 * | 6/2005 | Chen | 343/795 |

FOREIGN PATENT DOCUMENTS

| | | |
|---|---|---|
| JP | 2002-158531 A | 5/2000 |
| JP | 2003-78345 A | 3/2003 |

OTHER PUBLICATIONS

Complex Broadband Millimeter Wave Repsonse of a Double Quantum Dot: Rabi Oscillations in an Artifical Molecule; vol. 81, No. 3; Jul. 20, 1998; Physical Review Letters.

* cited by examiner

*Primary Examiner*—Hoanganh Le
(74) *Attorney, Agent, or Firm*—Sughrue Mion, PLLC

(57) ABSTRACT

A wide band antenna, which has a wide frequency band so that it can be used in a wireless local area network (WLAN) and can be manufactured in a small size at a low cost, is provided. The wide band antenna includes a first antenna unit, a supply cable, a first connector coupler, a second antenna unit, a balun, a stub, and a second connector coupler. A frequency band increases when coupling occurs between the stub and the first antenna unit or the second antenna unit.

16 Claims, 9 Drawing Sheets

WIDE BAND ANTENNA

CROSS-REFERENCE TO RELATED APPLICATIONS

This application claims the priority of Korean Patent Application No. 10-2004-0011908 filed on Feb. 23, 2004 in the Korean Intellectual Property Office and U.S. Provisional Patent Application No. 60/545,929 filed on Feb. 20, 2004 in the United States Patent and Trademark Office, the disclosures of which are incorporated herein by reference.

BACKGROUND OF THE INVENTION

1. Field of the Invention

The present invention relates to a wide band antenna, and more particularly, to a wide band antenna which has a wide frequency band so that it can be used in a wireless local area network (WLAN) and can be manufactured in a small size at a low cost.

2. Description of the Related Art

With the wide spread of the Internet and a rapid increase in multimedia data, demand for an ultrahigh-speed communication network increases. In particular, as portable computers or Personal Digital Assistants (PDAs) are widely spread, demand for accessing a network regardless of location increases, and thus, interest in a WLAN also rapidly increases. Although the WLAN has a lower data transmission rate than a wired LAN, the WLAN has advantages of mobility, portability, and simplicity. Therefore, a variety of services are provided in a wide frequency band through a WLAN in various fields of application. An antenna that is an essential element of a WLAN system necessarily has a wide frequency band to effectively provide a variety of services.

A conventional bow tie antenna will be described below with reference to FIG. 1. Generally, a bow tie antenna includes two triangular metal conductive patterns 11 and 12 disposed in a bow tie structure. The bow tie antenna is supplied with voltage through supply cables 13 and 14 and radiates signals in two directions of the two triangular metal conductive patterns 11 and 12. The bow tie antenna has a wide band frequency characteristic. However, since the conventional bow tie antenna requires an indefinitely large conductive pattern for supply cables (particularly, earth voltage supply cables), the conventional bow tie is difficult to utilize in communication network systems.

SUMMARY OF THE INVENTION

The present invention provides a wide band antenna which has a wide frequency band so that it can be used in a wireless local area network (WLAN) and can be manufactured in a small size at a low cost.

According to an aspect of the present invention, there is provided a wide band antenna comprising, a first antenna unit disposed on a first surface of a dielectric substrate; a supply cable disposed on the first surface of the dielectric substrate, the supply cable being connected to a center of a short side of the first antenna unit, thereby supplying voltage to the first antenna unit; a first connector coupler disposed above or below an end portion of the supply cable on the first surface of the dielectric substrate, the first connector coupler being spaced apart from the supply cable; a second antenna unit disposed on a second surface of the dielectric substrate without overlapping the first antenna unit, the second antenna unit comprising a knob having a notch shape which faces the short side of the first antenna unit; a balun disposed on the second surface of the dielectric substrate, the balun facing the supply cable and being connected to the knob of the second antenna unit; a second connector coupler disposed on the second surface of the dielectric substrate, the second connector coupler being connected to a side of the balun that is not connected to the knob of the second antenna unit; and a stub disposed between the second antenna unit and the balun on the second surface of the dielectric substrate, the stub being connected to the second connector coupler.

According to another aspect of the present invention, there is provided a wide band antenna comprising a first antenna unit disposed on a surface of a dielectric substrate; a supply cable connected to a center of a short side of the first antenna unit, thereby supplying voltage to the first antenna unit; a second antenna unit comprising a first branch, which is formed in a notch shape disposed above the supply cable to be spaced apart from the first antenna unit and the supply cable, and a second branch, which is formed in a notch shape disposed above the supply cable to run in parallel with the supply cable; a third antenna unit comprising a third branch, which is formed in a notch shape disposed below the supply cable to be spaced apart from the first antenna unit and the supply cable, and a fourth branch, which is formed in a notch shape disposed below the supply cable to run in parallel with the supply cable; a connector coupler to be connected to the second branch and the fourth branch of the respective second and third antenna units; and a stub disposed between either one of the first branch and the second branch of the second antenna unit or the third branch of the third antenna unit, the stub comprising a side connected to the connector coupler.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

Figure 1:
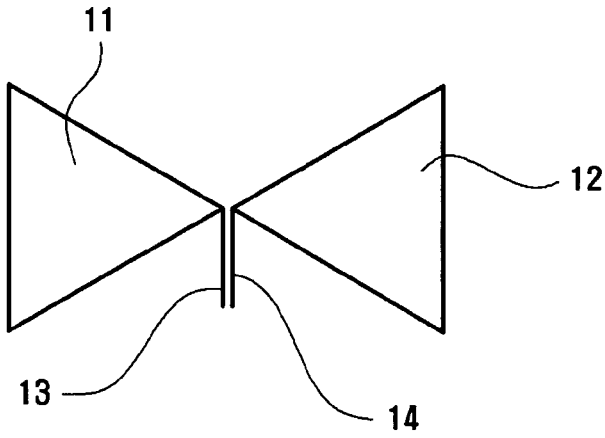
FIG. 1 is a plane view of a conventional bow tie antenna.

The advantages, and features of the present invention and methods for accomplishing the same will now be described more fully with reference to the accompanying drawings, in which a preferred embodiment of the invention are shown. This invention may, however, be embodied in many different forms and should not be construed as being limited to the embodiments set forth herein; rather, these embodiments are provided so that this disclosure will be thorough and complete, and will fully convey the concept of the invention to those skilled in the art. The invention is defined by the appended claims intended to cover all such modifications which may fall within the spirit and scope of the invention. Throughout the specification, the same reference numerals in different drawings represent the same element.

Figure 2A:
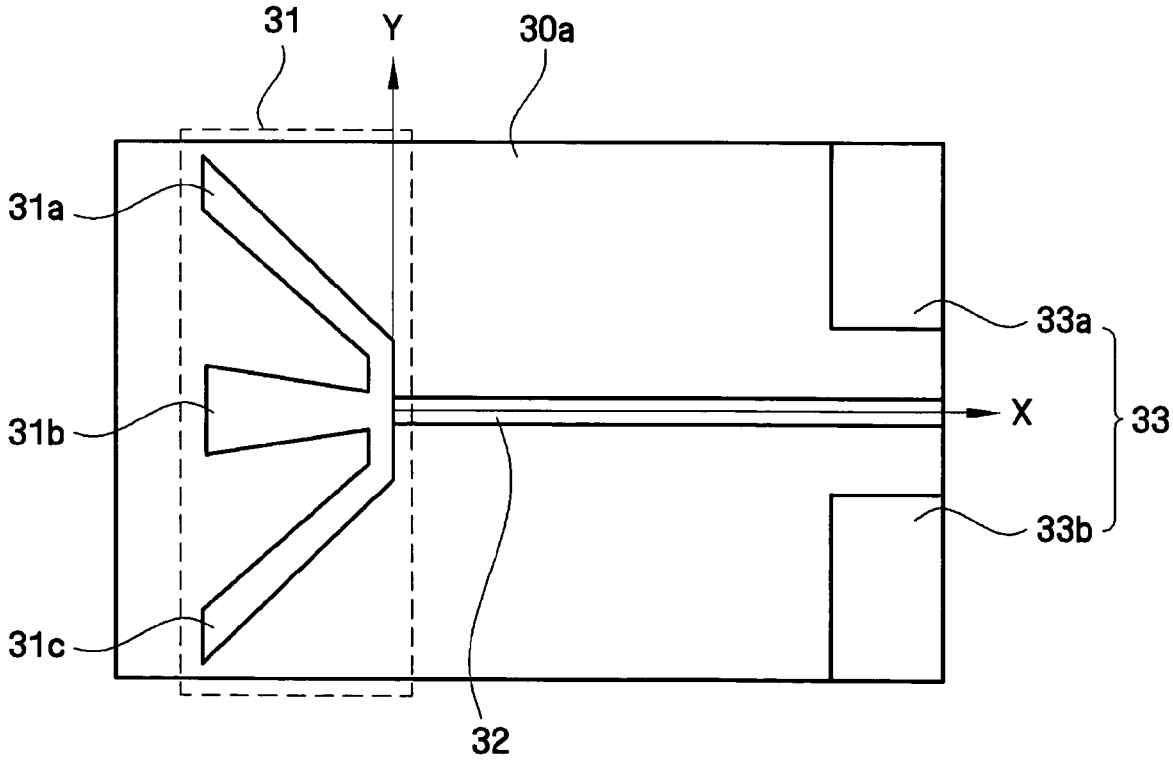
FIGS. 2A and 2B are plane and bottom views, respectively, of a wide band antenna according to a first embodiment of the present invention.
Figure 2B:
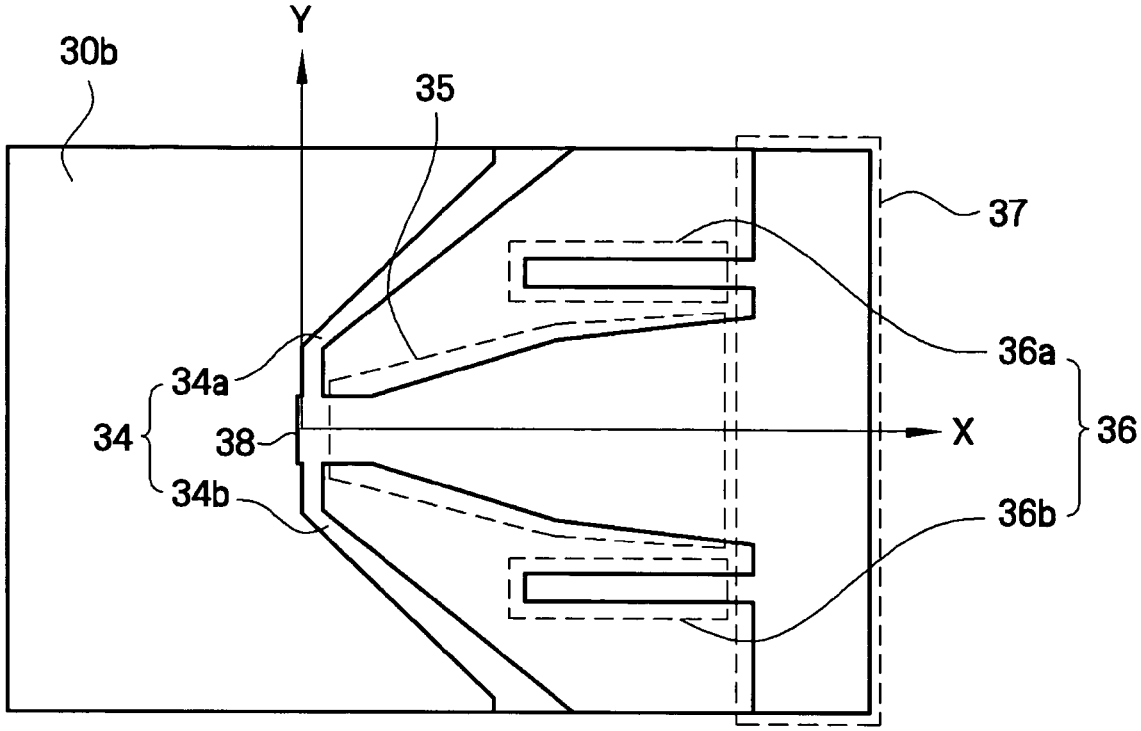

Referring to FIGS. 2A and 2B, a wide band antenna according to an exemplary embodiment of the present invention includes a first antenna unit 31, a supply cable 32, a first connector coupler 33, a second antenna unit 34, a balun 35, a stub 36, and a second connector coupler 37.

The first antenna unit 31 is formed of a metal conductor in a trapezoid shape on a first surface 30*a* of a dielectric substrate. The second antenna unit 34 is formed of a metal conductor in a notch shape on a second surface 30*b* of the dielectric substrate such that the second antenna unit 34 does not overlap with the first antenna unit 31. The second antenna unit 34 includes a knob 38 in a notch shape, which is spaced apart from the first antenna unit 31 and faces a center of a short side of the first antenna unit 31. The first antenna unit 31 and the second antenna unit 34 form a bow tie antenna. The first antenna unit 31 is not limited to the trapezoid shape. As shown in FIG. 2A, the first antenna unit 31 may have a plurality of branches 31*a*, 31*b*, 31*c* and entirely form a trapezoid shape. Also, the second antenna unit 34 may be formed in various shapes.

The supply cable 32 is formed of a metal conductor on the first surface 30*a* of the dielectric substrate such that the supply cable 32 is connected to the center of the short side of the first antenna unit 31, thereby supplying voltage to the first antenna unit 31. The balun 35 is formed of a metal conductor on the second surface 30*b* of the dielectric substrate such that the balun 35 faces the supply cable 32 and is connected to the knob 38 of the second antenna unit 34. The balun 35 is tapered toward the knob 38 of the second antenna unit 34 and transforms an unbalanced current mode into a balanced current mode. Since the balun 35 is formed within the second antenna unit 34, the size of the entire antenna can be reduced.

The first connector coupler 33 includes a third connector coupler 33*a*, which is formed of a metal conductor and disposed at a portion above an end portion of the supply cable 32 on the first surface 30*a* of the dielectric substrate to be spaced apart from the supply cable 32. Additionally, or alternatively, the first connector coupler 33 may include a fourth connector coupler 33*b*, which is formed of a metal conductor and disposed at a portion below the end portion of the supply cable 32 on the first surface 30*a* of the dielectric substrate to be spaced apart from the supply cable 32. The third connector coupler 33*a* and the fourth connector coupler 33*b* are symmetric vertically. The first connector coupler 33 is coupled to a coaxial cable connector. The first connector coupler 33 does not necessarily include both the third connector coupler 33*a* and the fourth connector coupler 33*b* on the first surface 30*a* of the dielectric substrate. However, when the first connector coupler 33 includes both the third connector coupler 33*a* and the fourth connector coupler 33*b*, the first connector coupler 33 can be more efficiently coupled to the coaxial cable connector.

The second connector coupler 37 is formed of a metal conductor on the second surface 30*b* of the dielectric substrate such that the second connector coupler 37 is connected to the stub 36. The second connector coupler 37 is connected to a side of the balun 35 that is not connected to the knob 38 of the second antenna unit 34 and is connected to the coaxial cable connector.

The stub 36 is formed of a metal conductor on the second surface 30*b* of the dielectric substrate such that the stub 36 is connected to the second connector coupler 37 between the second antenna unit 34 and the balun 35. Since the stub 36 is connected to the second connector coupler 37, one side of the stub 36 is grounded. The stub 36 grounded at its one side induces perturbation of current distribution on the ground, thereby giving a finite ground size. Accordingly, the size of the entire antenna can be reduced.

The stub 36 includes a first stub 36a, which is disposed between an upper portion 34*a* of the second antenna unit 34 and the balun 35 on the second surface 30*b* of the dielectric substrate such that the first stub 36*a* is spaced apart from the upper portion 34*a* of the second antenna unit 34 and the balun 35. The stub 36 also includes a second stub 36*b*, which is disposed between a lower portion 34*b* of the second antenna unit 34 and the balun 35 such that the second stub 36*b* is spaced apart from the lower portion 34*b* of the second antenna unit 34 and the balun 35. The first stub 36*a* and the second stub 36*b* are symmetric vertically.

Figure 4A:
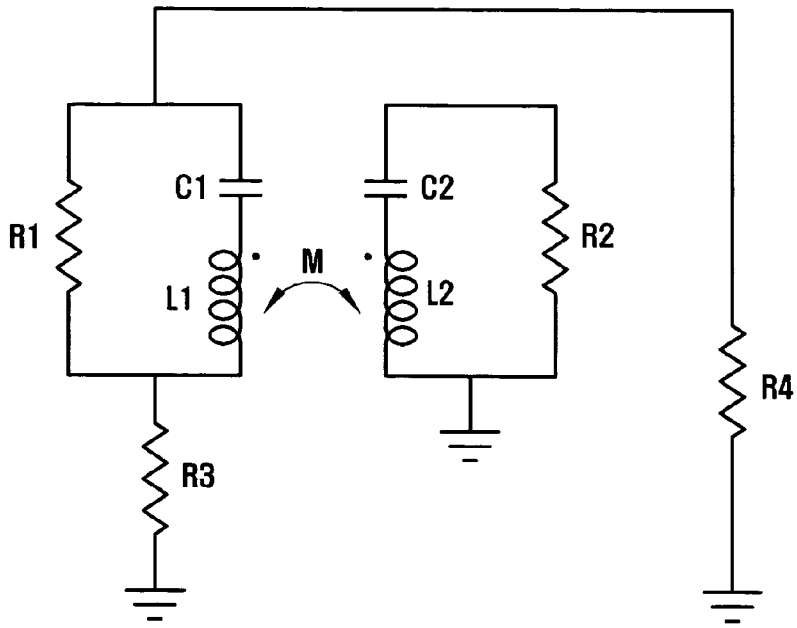
FIG. 4A illustrates an equivalent circuit of a wide band antenna according to the present invention.

FIG. 4A illustrates an equivalent circuit of a wide band antenna according to the present invention. The equivalent circuit shown in FIG. 4A correlates to the wide band antenna according to the first embodiment of the present invention in the following manner. Circuit elements L1, C1, and R1 represent the first and second antenna units 31 and 34, whereas circuit elements L2, C2, and R2 represent the stub 36. Since one side of the stub 36 is grounded, the resonant circuit comprised of elements L2, C2, and R2 is also grounded. The coupling coefficient M located between L1 and L2 in FIG. 4A represents radiation coupling between the first and second antenna units 31 and 34 and the stub 36. Resistor R3 represents the resistance of an RF signal source, (not shown) which drives the first and second antenna units 31 and 34. Circuit element R1 represents non-radiation losses associated with electromagnetic energy dissipation due to finite conductivity of real conductors in the first and second antenna units 31 and 34. Resistor R2 represents dissipation and radiation losses in the stub 36, whereas resistor R4 represents radiation losses of the first and second antenna units 31, 34.

The lumped elements equivalent circuit shown in FIG. 4A is a rough representation for the wide band antenna according to the present invention, which only aims qualitatively to explain the operating frequency band widening due to the coupling effects in the antenna. Generally, the usage of the lumped elements equivalent circuit is quite common in antenna theory and technique. (see, e.g., Constantine A. Balanis, "Antenna Theory Analysis and Design," Second Edition, John Wiley & Sons, Inc. New York, Chichester, Brisbane, Toronto, Singapore, page 567, FIG. 11.15).

Figure 4B:
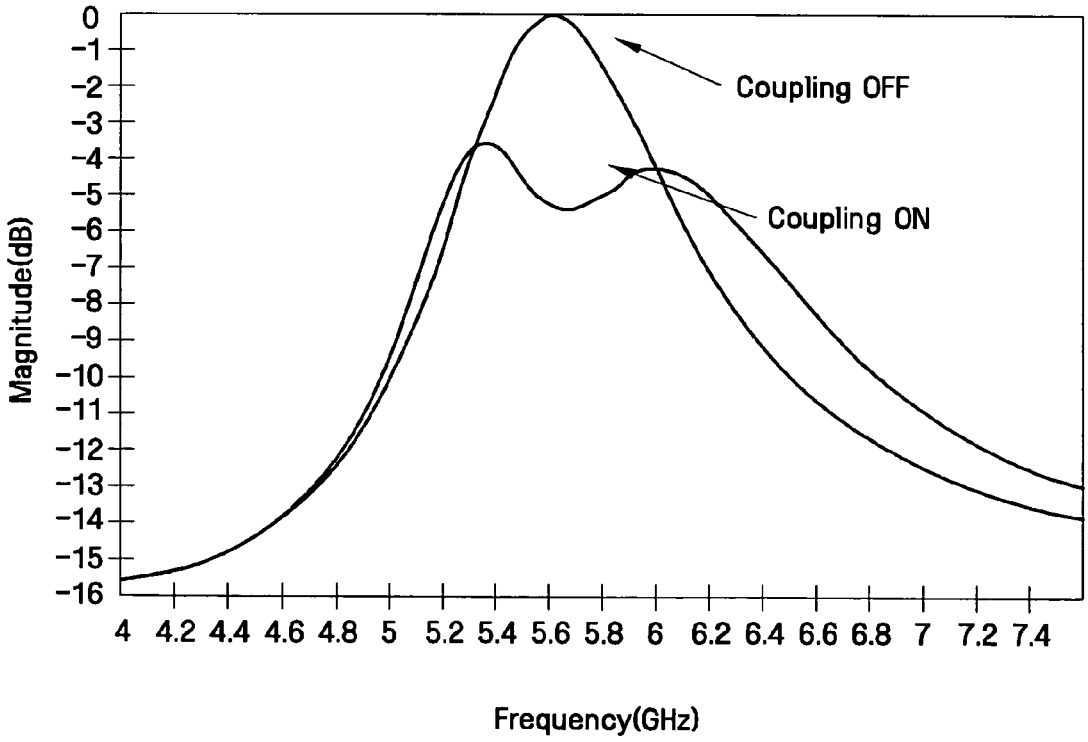
FIG. 4B is a graph illustrating a frequency characteristic of a wide band antenna according to the present invention.

Interactions between the stub 36 having one side grounded and the first antenna unit 31 or the second antenna unit 34 will be described with reference to FIG. 4B. FIG. 4B is a graph illustrating a frequency characteristic of a wide band antenna according to the present invention.

Input impedance of the stub 36 is influenced by coupling impedance induced by coupling between the stub 36 and the first antenna unit 31 or the second antenna unit 34 and the perturbation of current distribution on the ground. Due to the coupling impedance or the perturbation of current distribution, antenna matching can be improved, and radiation efficiency can be increased. For example, reactance induced by coupling in an antenna can counterbalance initial reactance in the antenna, and therefore, radiation efficiency can be increased. As a result, it can be inferred from FIG. 4B that a frequency band increases when coupling occurs between the stub 36 and the first antenna unit 31 or the second antenna unit 34 (Coupling ON), as compared to when the stub 36 is not present and thus coupling does not occur (Coupling OFF). For instance, the curve marked "Coupling OFF" in FIG. 4B demonstrates the ratio of the RF power emitted by resistor R3 and incident on the circuit comprised of elements L1, C1, and R1 to the RF power dissipated in resistor R4, which is expressed in dB. As shown in FIG. 4B, the curve marked "Coupling OFF" illustrates that at the resonant frequency all the power is transferred from R3 to R4, provided that losses in R1 are small. In terms of the wide band antenna, this indicates that all the power transmitted by the signal source, represented by R3, is dissipated in the outer space, represented by R4. In other words, all the incident power is radiated and no power returned back to the signal source (R3), which results in high radiation efficiency of the wide band antenna in the vicinity of the resonant frequency. On the other hand, the curve marked "Coupling ON" in FIG. 4B illustrates the widening of the frequency response when coupling effects are included in a simulation. With respect to the wide band antenna according to the first embodiment of the present invention, this indicates that introducing coupled resonant elements, such as the stubs 36*a* and 36*b* (or the stubs 24*a* and 24*b* described below with respect to the wide band antenna according to the second embodiment of the present invention) to the antenna structure results in broadening of the antenna frequency band with high radiation efficiency.

A resonance frequency at which the stub 36 is coupled with the first antenna unit 31 or the second antenna unit 34 is within a band of frequency at which the first antenna unit 31 or the second antenna unit 34 performs radiation. Preferably, the length of the stub 36 is one fourth (¼) of the wavelength of the resonance frequency.

Both of the first and second stubs 36*a* and 36*b* are not necessarily provided on the second surface 30*b* of the dielectric substrate, but when both of the first and second stubs 36*a* and 36*b* are provided, coupling between the stub 36 and the first antenna unit 31 or the second antenna unit 34 occurs more effectively, thereby further increasing a frequency band. It is preferable that the stub 36 is parallel with the supply cable 32.

As described above, according to the first embodiment of the present invention, a wide band antenna includes a balun 35, a stub 36, a first antenna unit 31, a second antenna unit 34, a supply cable 32, a first connector coupler 33, and a second connector coupler 37 so that the size of the wide band antenna is reduced. As a result, the wide band antenna can be manufactured at a low cost. In addition, the wide band antenna can have a wider frequency band due to coupling between the stub 36 and the first antenna unit 31 or the second antenna unit 34.

Figure 5:
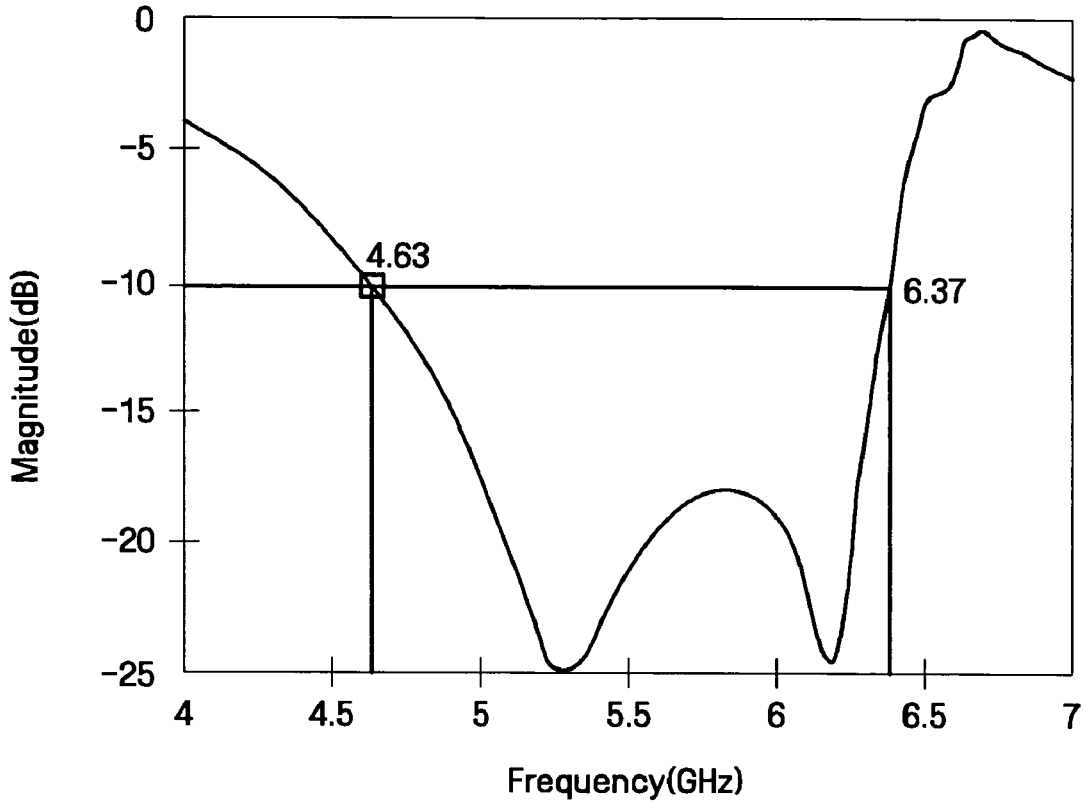
FIG. 5 is a graph illustrating reflection loss with respect to a frequency in a wide band antenna according to an exemplary embodiment of the present invention.

FIG. 5 is a graph illustrating reflection loss with respect to a frequency in a wide band antenna according to an exemplary embodiment of the present invention. Referring to FIG. 5, the wide band antenna has a reflection loss of 10 dB in a frequency band (32%) between 4.63 GHz and 6.37 GHz in a simulation. Accordingly, the wide band antenna according to the present invention conforms to the Institute of Electrical and Electronics Engineers (IEEE) 802.11a standard which defines a frequency band of a wireless local area network (WLAN). As a consequence, the wide band antenna according to the present invention can be used in the WLAN.

Figure 6:
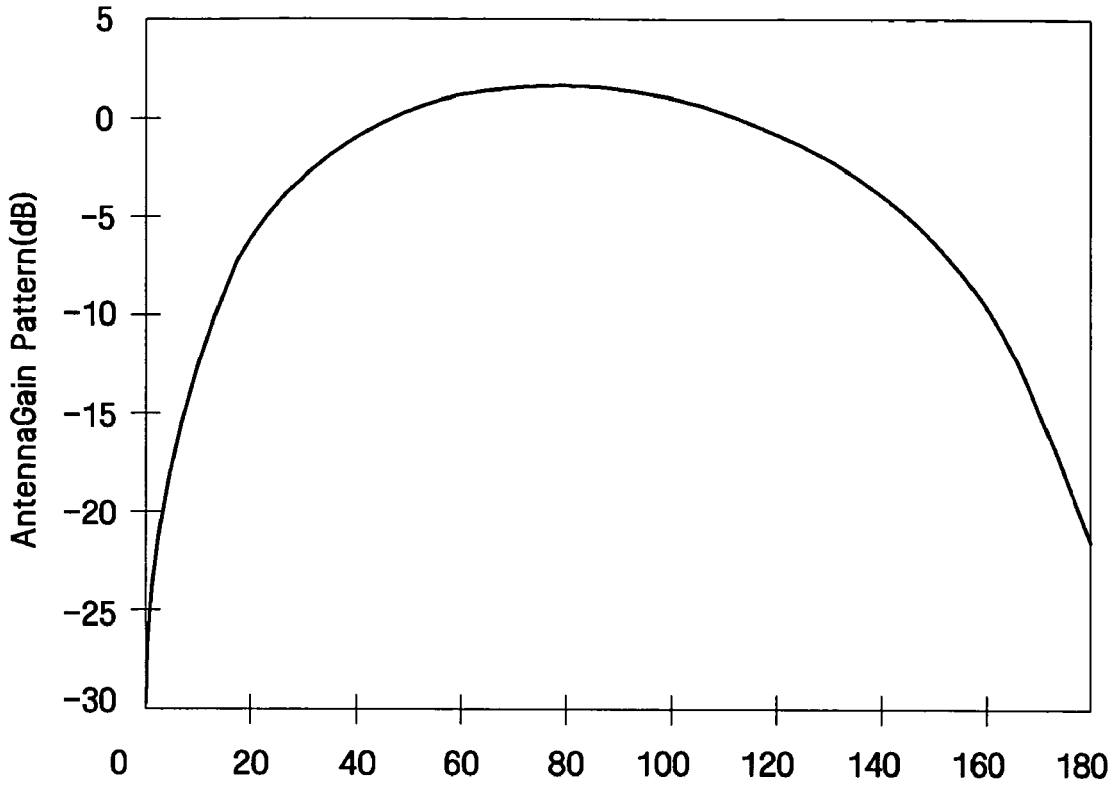
FIG. 6 is a graph illustrating a gain with respect to an angle of a wide band antenna according to an exemplary embodiment of the present invention.

FIG. 6 is a graph illustrating a gain with respect to an angle of a wide band antenna according to an exemplary embodiment of the present invention. Referring to FIG. 6, the wide band antenna according to the present invention has a maximum gain of 2 dBi.

Figure 7A:
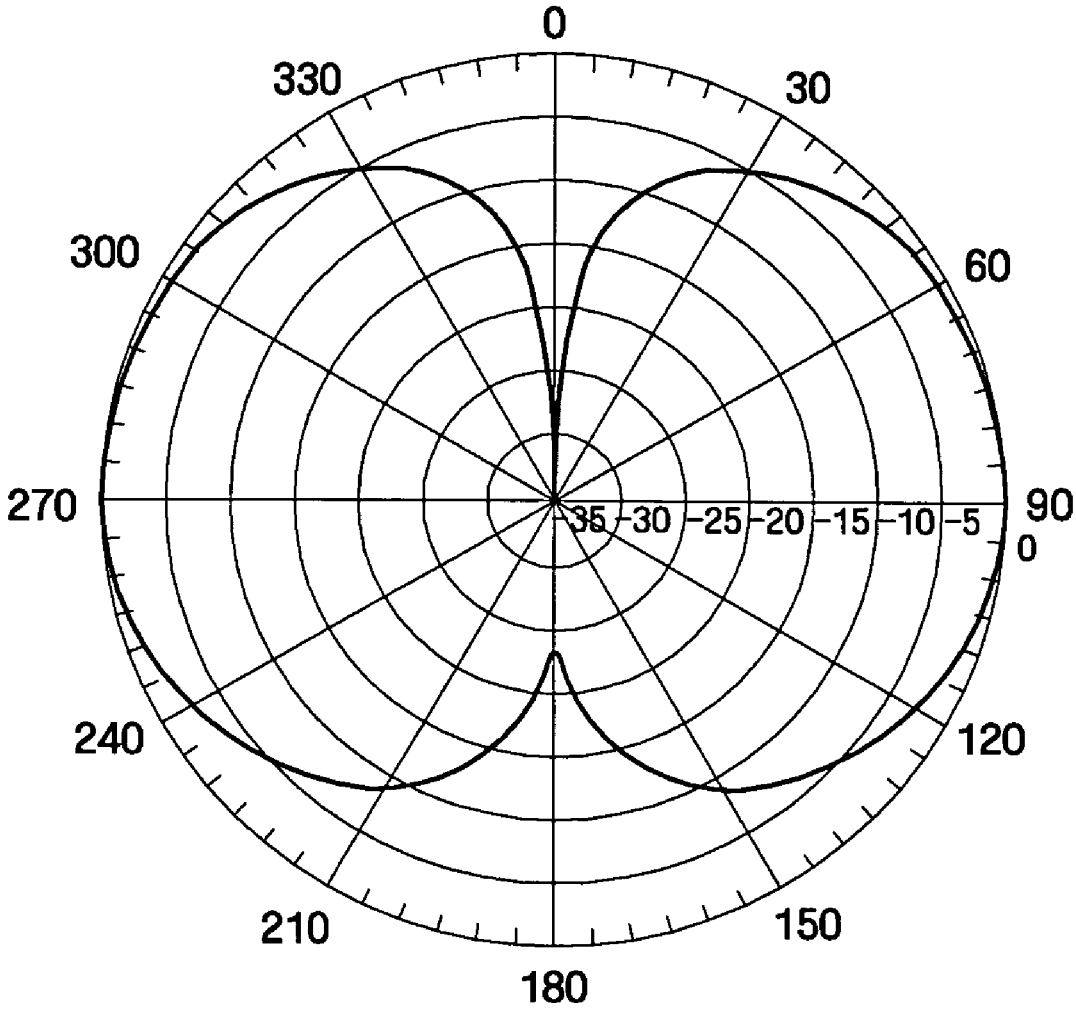
FIG. 7A is a graph illustrating 2-dimensional E-plane radiation pattern of a wide band antenna according to an exemplary embodiment of the present invention.
Figure 7B:
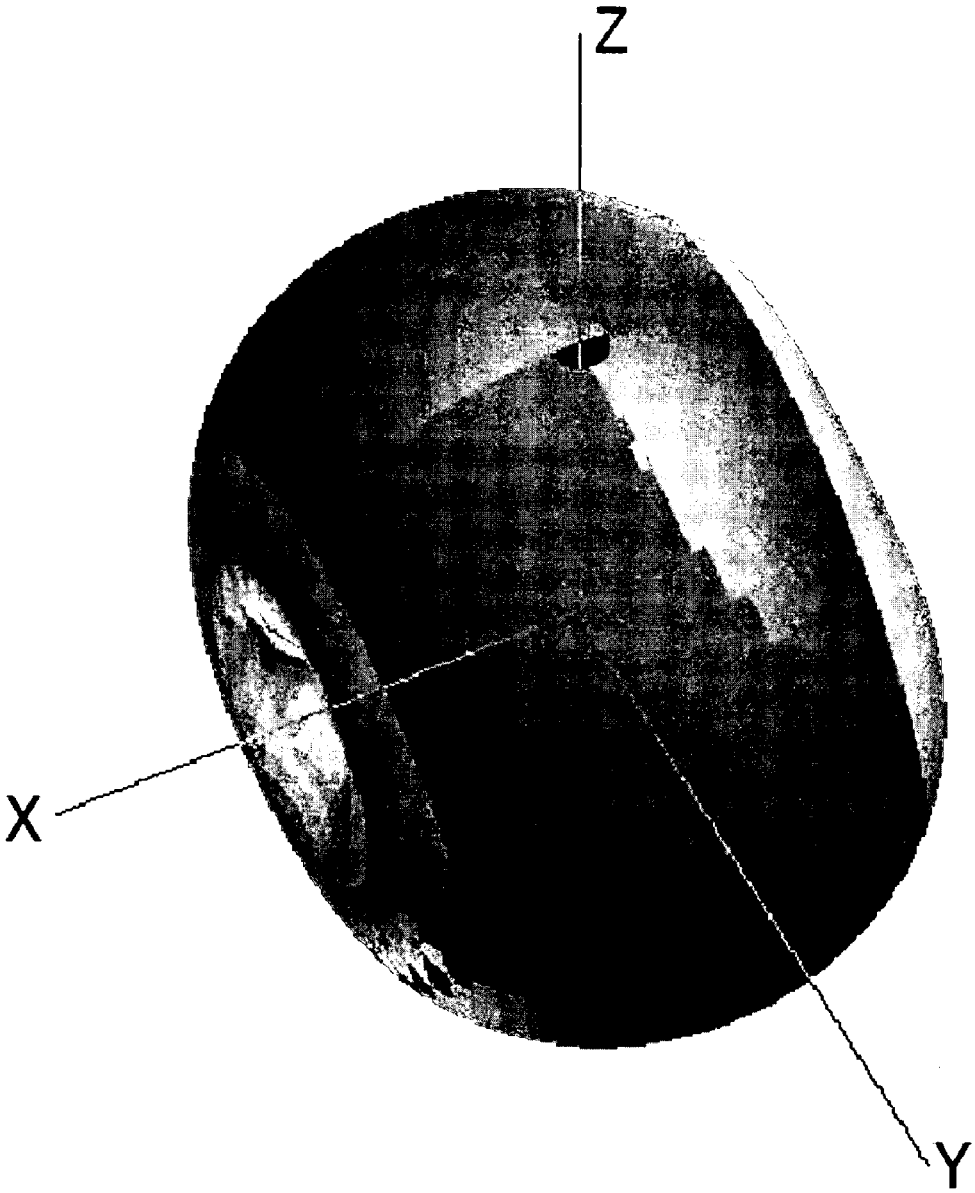
FIG. 7B is a graph illustrating 3-dimensional E-plane radiation pattern of a wide band antenna according to an exemplary embodiment of the present invention.

FIG. 7A is a graph illustrating 2-dimensional E-plane radiation pattern of a wide band antenna according to an exemplary embodiment of the present invention. Referring to FIG. 7A, the wide band antenna according to the present invention does not have particular directionality in two dimensions. FIG. 7B is a graph illustrating 3-dimensional E-plane radiation pattern of a wide band antenna according to an exemplary embodiment of the present invention.

As shown in FIG. 7B, the wide band antenna according to the present invention does not have particular directionality in three dimensions.

Figure 3:
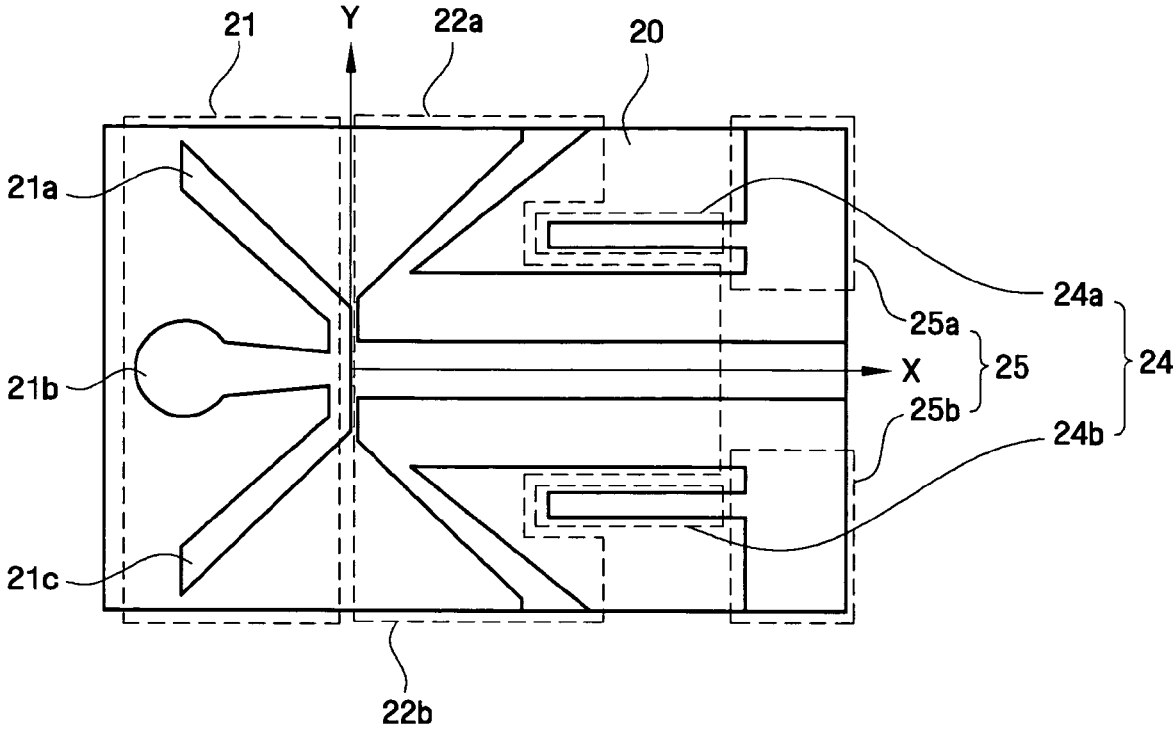
FIG. 3 is a plane view of a wide band antenna according to a second embodiment of the present invention.

FIG. 3 is a plane view of a wide band antenna according to a second embodiment of the present invention.

The wide band antenna according to the second embodiment of the present invention includes a first antenna unit 21, a supply cable 23, a connector coupler 25, having couplers 25*a* and 25*b*, a second antenna unit 22*a*, a third antenna unit 22*b*, and a stub 24.

The first antenna unit 21 is formed of a metal conductor in a trapezoid shape on a surface 20 of a dielectric substrate. The second antenna unit 22*a* is formed of a metal conductor on the surface 20 of the dielectric substrate. The second antenna unit 22*a* includes a first branch, which is formed in a notch shape above the supply cable 23 to be spaced apart from the first antenna unit 21 and the supply cable 23, and a second branch, which is formed in a notch shape above the supply cable 23 to run in parallel with the supply cable 23. The third antenna unit 22*b* is formed of a metal conductor on the surface 20 of the dielectric substrate. The third antenna unit 22*b* includes a first branch, which is formed in a notch shape below the supply cable 23 to be spaced apart from the first antenna unit 21 and the supply cable 23, and a second branch, which is formed in a notch shape below the supply cable 23 to run in parallel with the supply cable 23. The first antenna unit 21, the second antenna unit 22*a*, and the third antenna unit 22*b* form a bow tie antenna. The first antenna unit 21 is not limited to the trapezoid shape. As shown in FIG. 3, the first antenna unit 21 may have a plurality of branches 21*a*, 21*b*, 21*c* and entirely form a trapezoid shape. Also, the second and third antenna units 22*a* and 22*b* may be formed in various shapes.

The supply cable 23 is formed of a metal conductor on the surface 20 of the dielectric substrate such that the supply cable 23 is connected to a center of a short side of the first antenna unit 21, thereby supplying voltage to the first antenna unit 21. The connector coupler 25 is formed of a metal conductor on the surface 20 of the dielectric substrate such that the connector coupler 25 is spaced apart from the supply cable 23 and is connected to the second branches of the respective second and third antennas 22*a* and 22*b*. The connector coupler 25 is coupled to a coaxial cable connector.

The stub 24 is formed of a metal conductor disposed between either the first and second branches of the second antenna unit 22*a* or the first and second branches of the third antenna unit 22*b* on the surface 20 of the dielectric substrate. The stub 24 is connected to the connector coupler 25 so that one side of the stub 24 is grounded. The stub 24 grounded at its one side induces perturbation of current distribution on the ground, thereby giving a finite ground size. Accordingly, the size of the entire antenna can be reduced.

The stub 24 includes a first stub 24*a*, which is disposed between the first and second branches of the second antenna unit 22*a* on the surface 20 of the dielectric substrate to be spaced apart from the second antenna unit 22*a*. Additionally, the stub 24 includes a second stub 24*b*, which is disposed between the first and second branches of the third antenna unit 22*b* on the surface 20 of the dielectric substrate to be spaced apart from the third antenna unit 22*b*. The first and second stubs 24*a* and 24*b* are symmetric vertically.

The equivalent circuit shown in FIG. 4A correlates to the wide band antenna according to the second embodiment of the present invention in the following manner. Circuit elements L1, C1, and R1 represent the first through third antenna units 21, 22*a*, and 22*b*, whereas circuit elements L2, C2, and R2 represents the stub 24. Since one end of the stub 24 is grounded (as discussed above) the resonant circuit comprised of L2, C2, and R2 is also grounded. The coupling coefficient M located between L1 and L2 in FIG. 4 represents radiation coupling between the first through third antenna units 21, 22*a*, 22*b* and the stub 24. Circuit element R1 represents non-radiation losses, associated with electromagnetic energy dissipation due to finite conductivity of real conductors in the first through third antenna units 21, 22*a*, and 22*b*. Resistor R2 represents dissipation and radiation losses in the stub 24. Circuit element R4 represents the radiation losses of the first through third antenna units 21, 22*a*, 22*b* and resistor R3 represents the resistance of the RF signal source (not shown) which drives the first through third antenna units 21, 22*a*, and 22*b*.

Interactions between the stub 24 having one side grounded and the first through third antenna units 21, 22*a*, and 22*b* will be described with reference to FIG. 4B.

Input impedance of the stub 24 is influenced by coupling impedance induced by coupling between the stub 24 and the first through third antenna units 21, 22*a*, and 22*b* and the perturbation of current distribution on the ground. Due to the coupling impedance or the perturbation of current distribution, antenna matching can be improved, and radiation efficiency can be increased. For example, reactance induced by coupling in an antenna can counterbalance initial reactance in the antenna, and therefore, radiation efficiency can be increased. As a result, it can be inferred from FIG. 4B that a frequency band increases when coupling occurs between the stub 24 and the first through third antenna units 21, 22*a*, and 22*b* as compared to when the stub 24 is not present and thus coupling does not occur.

A resonance frequency at which the stub 24 is coupled with the first through third antenna units 21, 22*a*, and 22*b* is within a band of frequency at which the first through third antenna units 21, 22*a*, and 22*b* perform radiation. Preferably, the length of the stub 24 is ¼ of the wavelength of the resonance frequency.

Both of the first and second stubs 24*a* and 24*b* are not necessarily provided on the surface 20 of the dielectric substrate, but when both of the first and second stubs 24*a* and 24*b* are provided, coupling between the stub 24 and the first through third antenna units 21, 22*a*, and 22*b* occurs more effectively, thereby further increasing a frequency band. It is preferable that the stub 24 is parallel with the supply cable 23.

According to the second embodiment of the present invention, a wide band antenna is formed only on the surface 20. As discussed above, the wide band antenna according to the second embodiment of the present invention includes a stub 24, a supply cable 23, a connector coupler 25, having couplers 25*a* and 25*b*, a first antenna unit 21, a second antenna unit 22*a*, and a third antenna unit 22*b* so that the size of the wide band antenna is reduced. As a result, the wide band antenna can be manufactured at a low cost. In addition, the wide band antenna can have a wider frequency band due to coupling between the stub 24 and the first through third antenna units 21, 22*a*, and 22*b*.

Figure 8:
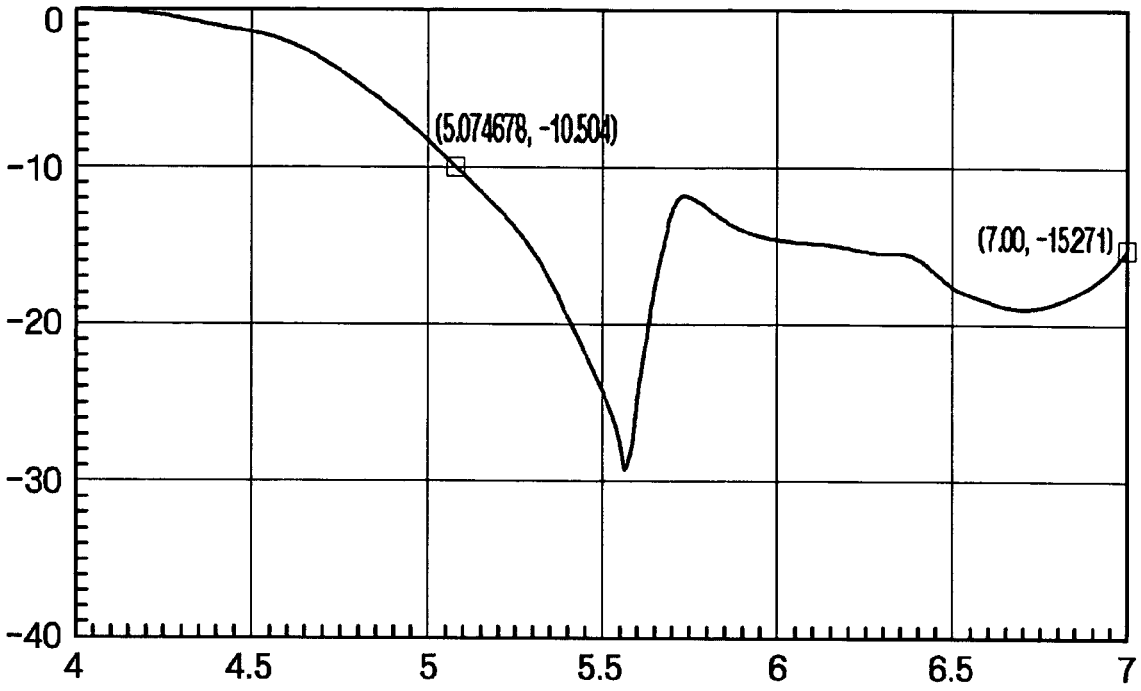
FIG. 8 is a graph illustrating a reflection loss with respect to a frequency in a wide band antenna according to a second embodiment of the present invention.

FIG. 8 is a graph illustrating reflection loss with respect to a frequency in a wide band antenna according to the second embodiment of the present invention. Referring to FIG. 8, a simulation of a wide band antenna according to the second embodiment of the present invention reveals that the wide band antenna has a reflection loss of 10 dB in a frequency band (33%) between 5.07 GHz and 7.0 GHz. Accordingly, the wide band antenna according to the second embodiment of the present invention conforms to the IEEE 802.11a standard which defines a frequency band of a WLAN. As a consequence, the wide band antenna according to the second embodiment of the present invention can be used in a WLAN.

Although exemplary embodiments of the present invention have been shown and described, it will be appreciated by those skilled in the art that changes or modifications may be made without departing from the spirit and scope of the invention. Therefore, the aforementioned exemplary embodiments are merely illustrative in every respect and should not be considered restrictive in any way.

As described above, according to the present invention, a wide band antenna which has a wide frequency band can be used in a WLAN and can be manufactured in a small size at a low cost.

What is claimed is:

1. A wide band antenna comprising:

a first antenna unit disposed on a first surface of a dielectric substrate;

a supply cable disposed on the first surface of the dielectric substrate, the supply cable being connected to a center of a short side of the first antenna unit, thereby supplying voltage to the first antenna unit;

a first connector coupler disposed above or below an end portion of the supply cable on the first surface of the dielectric substrate, the first connector coupler being spaced apart from the supply cable;

a second antenna unit disposed on a second surface of the dielectric substrate without overlapping the first antenna unit, the second antenna unit comprising a knob having a notch shape which faces the short side of the first antenna unit;

a balun disposed on the second surface of the dielectric substrate, the balun facing the supply cable and being connected to the knob of the second antenna unit;

a second connector coupler disposed on the second surface of the dielectric substrate, the second connector coupler being connected to a side of the balun that is not connected to the knob of the second antenna unit; and a stub disposed between the second antenna unit and the balun on the second surface of the dielectric substrate, the stub being connected to the second connector coupler.

2. The wide band antenna of claim 1, wherein the first antenna unit has a trapezoid shape.

3. The wide band antenna of claim 1, wherein the second antenna unit has a notch shape.

4. The wide band antenna of claim 1, wherein the first antenna unit is formed of a first metal conductor, wherein the supply cable is formed of a second metal conductor, wherein the first connector coupler is formed of a third metal conductor, wherein the second antenna unit is formed of a fourth metal conductor, wherein the balun is formed of a fifth metal conductor, wherein the second connector coupler is formed of a sixth metal conductor, and wherein the stub is formed of a seventh metal conductor.

5. The wide band antenna of claim 1, wherein a side of the balun is tapered toward the knob of the second antenna unit.

6. The wide band antenna of claim 1, wherein the stub comprises:

a first stub which is formed between an upper portion of the second antenna unit and an upper portion of the balun, the first stub being spaced apart from the upper portion of the second antenna unit and the upper portion of the balun; and a second stub which is formed between a lower portion of the second antenna unit and a lower portion of the balun, the second stub being spaced apart from the lower portion of the second antenna unit and the lower portion of the balun, and wherein the first stub and the second stub are symmetric vertically.

7. The wide band antenna of claim 1, wherein the stub is parallel with the supply cable.

8. The wide band antenna of claim 1, wherein a length of the stub is one fourth (¼) of a wavelength of resonance frequency at which the stub is coupled with one of the first and second antenna units.

9. The wide band antenna of claim 1, wherein the first connector coupler comprises at least one of:

a third connector coupler which is disposed above the end portion of the supply cable to be spaced apart from the supply cable; and a fourth connector coupler which is disposed below the end portion of the supply cable to be spaced apart from the supply cable, and wherein the third connector coupler and the fourth connector coupler are symmetric vertically.

10. A wide band antenna comprising:

a first antenna unit disposed on a surface of a dielectric substrate;

a supply cable, connected to a center of a short side of the first antenna unit, thereby supplying voltage to the first antenna unit;

a second antenna unit comprising a first branch, which is formed in a notch shape disposed above the supply cable to be spaced apart from the first antenna unit and the supply cable, and a second branch, which is formed in a notch shape disposed above the supply cable to run in parallel with the supply cable;

a third antenna unit comprising a third branch, which is formed in a notch shape disposed below the supply cable to be spaced apart from the first antenna unit and the supply cable, and a fourth branch, which is formed in a notch shape disposed below the supply cable to run in parallel with the supply cable;

a connector coupler, to be connected to the second branch and the fourth branch of the respective second and third antenna units; and a stub disposed between either one of the first branch and the second branch of the second antenna unit or the third branch and the fourth branch of the third antenna unit, the stub comprising a side connected to the connector coupler.

11. The wide band antenna of claim 10, wherein the first antenna unit has a trapezoid shape.

12. The wide band antenna of claim 10, wherein the supply cable, the second antenna unit, the third antenna unit, the connector coupler, and the stub are disposed on the surface of the dielectric substrate.

13. The wide band antenna of claim 10, wherein the first antenna unit is formed of a first metal conductor, wherein the supply cable is formed of a second metal conductor, wherein the second antenna unit is formed of a third metal conductor, wherein the third antenna unit is formed of a fourth metal conductor, wherein the connector coupler is formed of a fifth metal conductor, and wherein the stub is formed of a sixth metal conductor.

14. The wide band antenna of claim 10, wherein the stub comprises:

a first stub which is disposed between the first branch and the second branch of the second antenna unit on the surface of the dielectric substrate to be spaced apart from the second antenna unit; and a second stub, which is disposed between the third branch and the fourth branch of the third antenna unit on the surface of the dielectric substrate to be spaced apart from the third antenna unit, and wherein the first stub and the second stub are symmetric vertically.

15. The wide band antenna of claim 10, wherein the stub is parallel with the supply cable.

16. The wide band antenna of claim 10, wherein a length of the stub is one fourth (¼) of a wavelength of resonance frequency at which the stub is coupled with at least one of the first antenna unit and the second antenna unit and the third antenna unit.

* * * * *